US012721370B2

(12) United States Patent
Staiano et al.

(10) Patent No.: US 12,721,370 B2
(45) Date of Patent: Sep. 1, 2026

(54) PRE-GROUND SMOKING SYSTEM

(71) Applicant: Snapper Innovations, LLC, Miami, FL (US)

(72) Inventors: Mark Staiano, Miami, FL (US); Dan Talbot, Montreal (CA)

(73) Assignee: Snapper Innovations, LLC, Miami, FL (US)

( * ) Notice: Subject to any disclaimer, the term of this patent is extended or adjusted under 35 U.S.C. 154(b) by 100 days.

(21) Appl. No.: 18/347,360

(22) Filed: Jul. 5, 2023

(65) Prior Publication Data

US 2024/0008529 A1 Jan. 11, 2024

Related U.S. Application Data

(60) Provisional application No. 63/383,861, filed on Nov. 15, 2022, provisional application No. 63/358,390, filed on Jul. 5, 2022.

(51) Int. Cl.
*A24F 15/08* (2006.01)
*A24F 15/06* (2006.01)

(52) U.S. Cl.
CPC ..... *A24F 15/08* (2013.01); *A24F 15/06* (2013.01)

(58) Field of Classification Search
CPC ..... A24F 15/05; A24F 15/06; A24F 15/08; B65D 81/00
USPC ..... 206/242–276
See application file for complete search history.

(56) References Cited

U.S. PATENT DOCUMENTS

| | | | | |
|---|---|---|---|---|
| 175,877 | A | 4/1876 | Ross, Jr. | |
| 840,853 | A | 1/1907 | King | |
| 848,415 | A | 3/1907 | Vogelsang | |
| 1,884,007 | A | 10/1932 | Loblo | |
| 2,708,593 | A | 5/1955 | Benoist | |
| 3,365,102 | A * | 1/1968 | Castleberry | A24F 42/20 131/273 |
| 4,214,658 | A * | 7/1980 | Crow | A24F 23/04 206/253 |
| 5,465,738 | A * | 11/1995 | Rowland | A24F 23/04 206/256 |
| 5,848,596 | A * | 12/1998 | Zelenik | A24F 23/04 131/180 |
| 5,967,312 | A * | 10/1999 | Jacobs | A24F 23/04 206/242 |
| 6,086,931 | A * | 7/2000 | Whiteford | B65D 85/324 426/106 |
| 6,601,586 | B2 | 8/2003 | Herrick | |
| 6,736,143 | B2 * | 5/2004 | Rennecamp | A24F 23/00 206/242 |
| 6,814,081 | B2 * | 11/2004 | Hasler | A24F 19/0064 220/253 |
| 7,798,319 | B1 * | 9/2010 | Bried | B65D 51/16 220/366.1 |

(Continued)

*Primary Examiner* — Chun Hoi Cheung
(74) *Attorney, Agent, or Firm* — McHale & Slavin. P.A.

(57) ABSTRACT

The invention involves a system and device for providing leaf type smoking material from a retailer or dispensary in a pre-ground and cleaned form. The system includes a container liner for containing the smoking material along with a smoking implement inside the container liner. The smoke container, as well as the smoking implement, are constructed and arranged to cooperate with various smoking or vaporizing devices, which allows the smoker to choose which device in which the material is smoked or vaporized for ingestion.

13 Claims, 6 Drawing Sheets

(56) References Cited

U.S. PATENT DOCUMENTS

| | | | | |
|---|---|---|---|---|
| D657,091 | S | 4/2012 | Braveman | |
| 8,813,758 | B2 | 8/2014 | Braveman | |
| 8,967,382 | B2 * | 3/2015 | Liu | A24F 15/01 206/265 |
| 9,427,022 | B2 | 8/2016 | Levin et al. | |
| 10,258,081 | B1 * | 4/2019 | Goradesky | A24F 1/28 |
| 11,918,040 | B1 * | 3/2024 | Snyder | A24F 17/00 |
| 2005/0028369 | A1 | 2/2005 | Cocchiarella et al. | |
| 2008/0314778 | A1 * | 12/2008 | Hatton | A24F 9/00 206/256 |
| 2013/0133672 | A1 | 5/2013 | Walsh | |
| 2014/0023747 | A1 * | 1/2014 | Galluch | A21D 8/02 220/573.1 |
| 2015/0021216 | A1 * | 1/2015 | Blagojevic | B65D 43/0214 206/265 |
| 2016/0100715 | A1 | 4/2016 | Staiano et al. | |
| 2016/0165952 | A1 * | 6/2016 | Liu | A24F 15/12 206/256 |
| 2016/0167846 | A1 * | 6/2016 | Zahr | B65D 43/165 206/268 |
| 2017/0035105 | A1 * | 2/2017 | Jordan | A24F 9/08 |
| 2020/0138100 | A1 * | 5/2020 | Takehara | A24F 40/30 |

* cited by examiner

PRE-GROUND SMOKING SYSTEM

RELATED APPLICATIONS

The present application claims priority of U.S. Provisional Application No. 63/358,390, filed Jul. 5, 2022, entitled "Pre-Ground Smoking System"; the present application also claims priority to U.S. Provisional Application No. 63/383,861, filed Nov. 15, 2022, entitled "Pre-Ground Smoking System". The contents of the above referenced applications are incorporated herein.

FIELD OF INVENTION

The present invention generally relates to systems for smoking tobacco or herbs; and more particularly, to a prepackaged container of smoking material and a smoking device that can be utilized across a plurality of smoking methods in combination with a variety of smoking devices.

BACKGROUND INFORMATION

One of the first dilemmas faced by a smoker is picking a delivery method for the smoking material. A huge variety of devices exists for the delivery of smoke and/or vapor from a smoking material. Rolling papers are probably one of the oldest and most known means of smoke delivery. The rolling papers may be constructed from wood, rice, tobacco leaves, bamboo, hemp or a combination of various pulps, and may contain flavors or coloring. In this case, the smoker can roll the smoking material into a cigarette form, by hand or machine, to be smoked. However, there are known drawbacks to smoking paper, including bad taste or carcinogens associated with burning the paper that the smoker may not want to ingest.

Another method of smoke delivery is the one hitter. A one hitter is a small pipe with a narrow bowl that is designed and used for a single inhalation before the smoking material is depleted. A variation on the one hitter is the pipe. Pipes may be constructed of various materials and include a larger bowl for holding a larger amount of smoking material. Yet another variation of the pipe is the water pipe or "bong" as they are commonly known. The bong includes a water filter through which the smoke or vapor is pulled while the smoker is inhaling. The water removes some contaminants and cools the smoke or vapor. Still yet another variation uses heat to simply heat the smoking material until vapor is given off for inhalation. These devices include a kettle or bowl in which the smoking material is heated, typically by an electrical element, to create the vapor.

One drawback applies to all of these methods of smoke or vapor delivery. Typically, the smoking material grows as a natural plant to include natural stems and seeds. In addition, the material grows in a form that is impossible, or at least extremely difficult, to smoke or vaporize in its natural form. Thus, the smoking material must be torn into small pieces and the undesired portions removed. This is typically a time consuming process and is very difficult to accomplish when a smoker is someplace other than home where there is access to scissors, grinders, trays, etc. for chopping and sorting the material.

Thus, what is needed in the art is a smoking system that utilizes a container liner filled with pre-ground and cleaned smoking material and includes a smoking implement within the container liner. The smoking implement should be adapted for use with various smoking devices and methods, such that the smoker can smoke the material directly with the smoking implement or connect the smoking implement to various other smoking and vaporizing devices for use.

SUMMARY OF THE INVENTION

Briefly, the invention involves a device and system providing leaf type smoking material from a retailer or dispensary in a pre-ground and cleaned form. The system includes a container liner for containing the smoking material along with a smoking implement inside the container liner. The smoke container, as well as the smoking implement, are constructed and arranged to cooperate with various smoking or vaporizing devices, which allows the smoker to choose which device in which the material is smoked or vaporized for ingestion.

Accordingly, it is an objective of the present invention to provide a smoke container for pre-ground and cleaned smoking material that includes a smoking implement contained within a container liner.

It is a further objective of the present invention to provide a smoking system that includes pre-ground and cleaned smoking material and a smoking implement that can be utilized to smoke the material in a single smoke container.

It is yet a further objective of the present invention to provide a container liner for pre-ground and cleaned smoking material that includes a smoking implement in the container liner, wherein the smoking implement is constructed to cooperate with various smoking implements and methods.

It is another objective of the present invention to provide a container liner for pre-ground and cleaned smoking material that includes a smoking implement in the container that is suitable for point of sale distribution.

Still another objective of the present invention is to provide a container liner with pre-ground smoking material that is constructed and arranged to fit within pre-existing or new smoking devices for storage and use.

A still further objective of the present invention is to provide a container and smoking implement wherein the container includes a seal to preserve the smoking material for long term storage.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENTS

Figure 1:
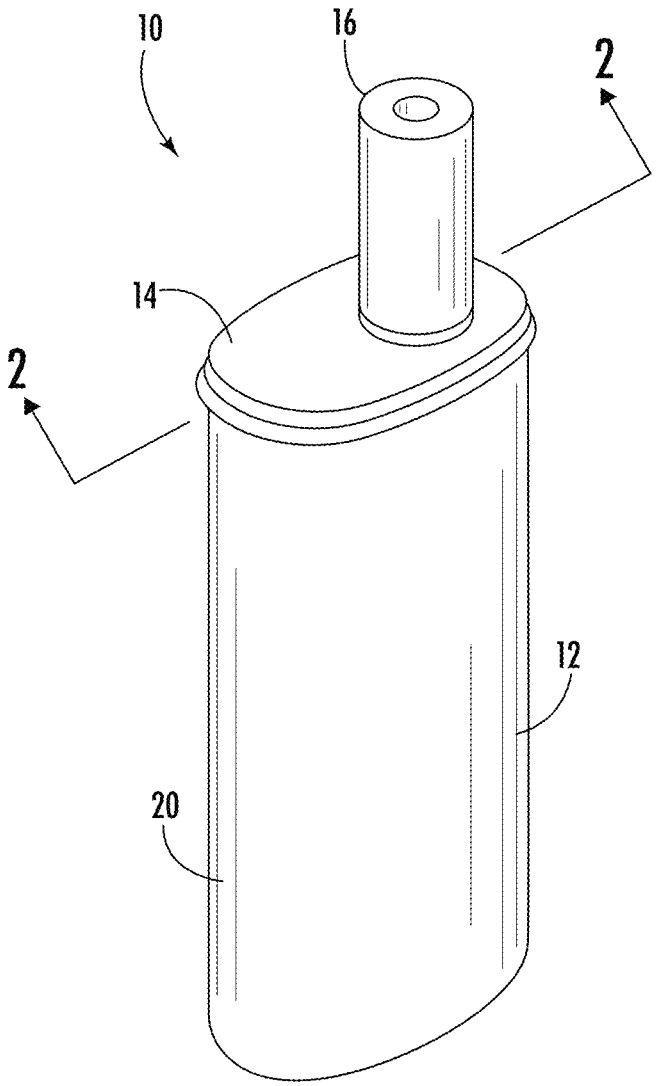
FIG. 1 is a top front left perspective view of one embodiment of a container liner filled with smoking material and a smoking implement.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
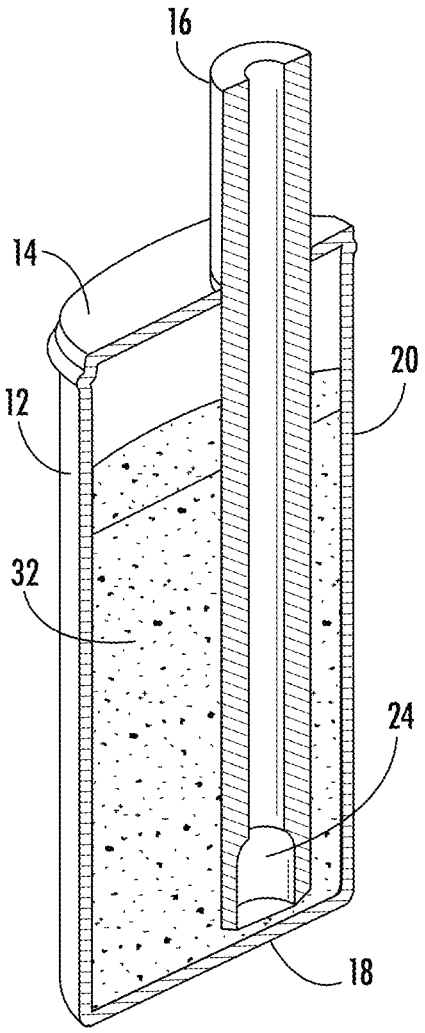
FIG. 2 is a top front left section view taken along lines 2-2 of FIG. 1 illustrating the container liner filled with smoking material and a smoking implement.
Figure 3:
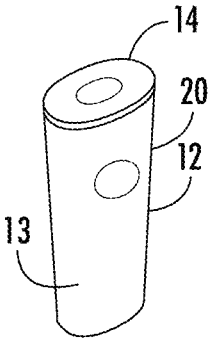
FIG. 3 is a top front left view of another embodiment wherein the smoking implement is completely inside the container liner and a breakable tamper seal member.
Figure 4:
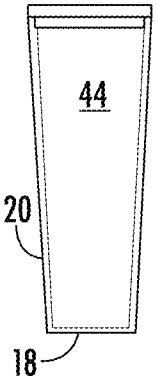
FIG. 4 is a front view of the container liner with a lid member in position.
Figure 5:
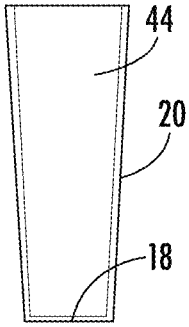
FIG. 5 is a front view of the container liner without the lid member.
Figure 6:
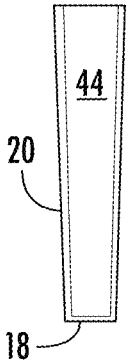
FIG. 6 is a left side view of the container liner of FIG. 5, the right side view being a mirror image thereof.
Figure 7:
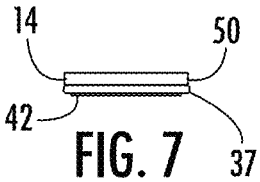
FIG. 7 is a top view of a lid member suitable for use with the container liner of FIG. 5.
Figure 8:
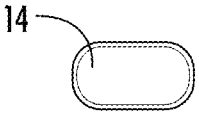
FIG. 8 is a side view of a lid member suitable for use with the container liner of FIG. 5.
Figure 9:
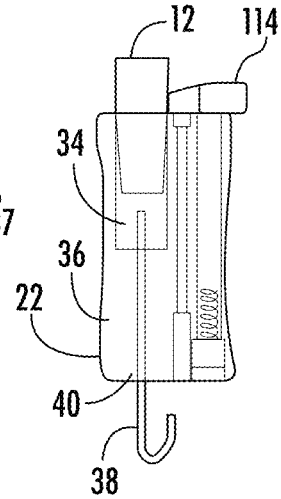
FIG. 9 is a front view illustrating removal of a container liner from a one hitter box.
Figure 10:
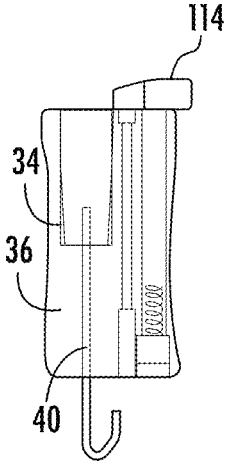
FIG. 10 is a front view of a one hitter box with the container liner of FIG. 5 in position.
Figure 11:
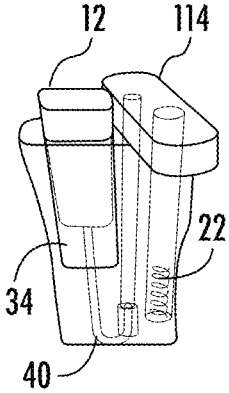
FIG. 11 is a top front perspective view illustrating the container liner being removed from the one hitter box with a poker element.
Figure 12:
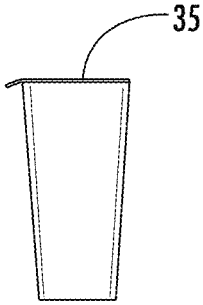
FIG. 12 is a front view of the container liner with the lid in position.
Figure 13:
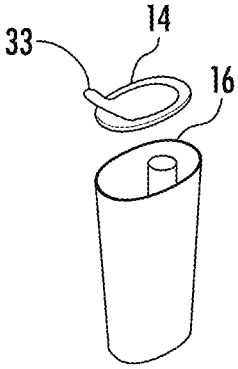
FIG. 13 is a top left perspective view of the container liner with the lid removed and the tamper seal broken.
Figure 14:
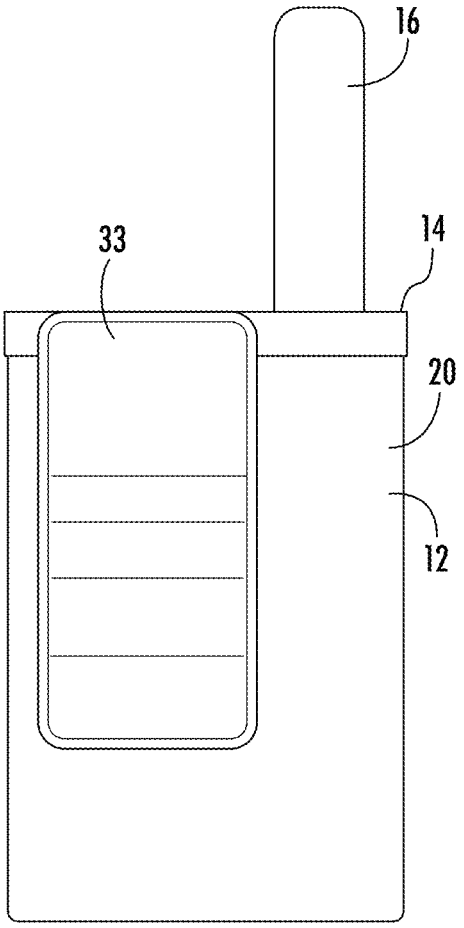
FIG. 14 is a front view of a container liner marked and tamper sealed with the contents.
Figure 15:
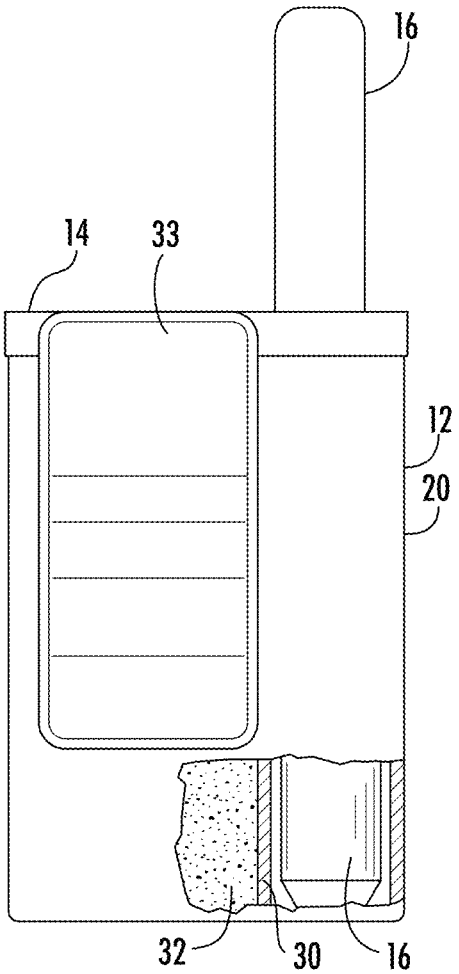
FIG. 15 is a front view of a container liner, partially in section, illustrating the inner construction of the container liner.
Figure 16:
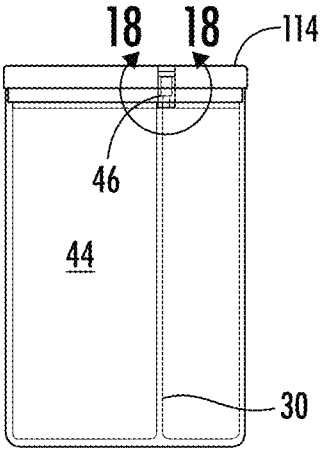
FIG. 16 is a side view of a container liner having a rotating lid.
Figure 17A:
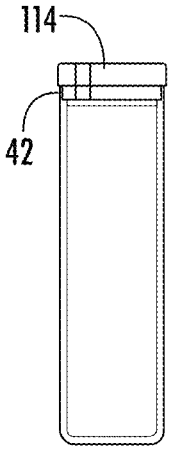
FIG. 17A is a left side view of the container liner illustrated in FIG. 16.
Figure 17B:
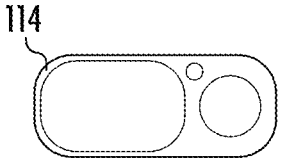
FIG. 17B is a top view of the container liner illustrated in FIG. 16.
Figure 18:
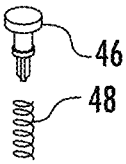
FIG. 18 is a partial view taken along lines 18-18 of FIG. 16 illustrating the hold down screw for the lid member.
Figure 19:
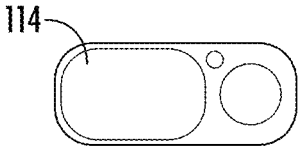
FIG. 19 is a top view of one embodiment of the lid member constructed from silicone.
Figure 20:
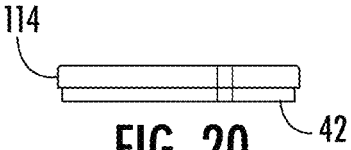
FIG. 20 is a side view of the lid member illustrated in FIG. 19.
Figure 21:
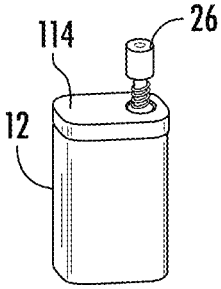
FIG. 21 is a top perspective view illustrating an extendable smoking implement in combination with a pivoting lid container liner.
Figure 22:
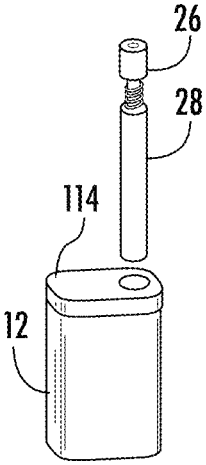
FIG. 22 is a top perspective view illustrating removal of the extendable smoking implement from the container liner.
Figure 23:
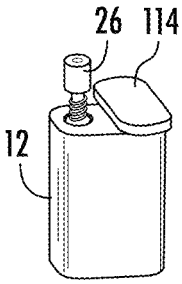
FIG. 23 is a top perspective view illustrating rotation of the container liner lid member after removal of the extendable smoking implement from the container liner.
Figure 24:
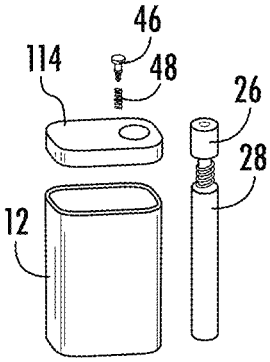
FIG. 24 is a top perspective exploded view illustrating the components of the smoking system without the smoking material.
Figure 25:
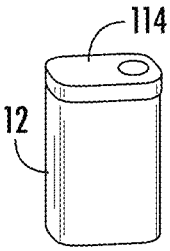
FIG. 25 is a top perspective view illustrating the pivoting lid container liner without the smoking implement.

Referring generally to FIGS. 1-35, a smoking system 10 for smoking materials such as tobacco, marijuana, etc. is illustrated. The smoking system 10 includes, in its simplest form, a container 12, a lid member 14 and a smoking implement 16. The container 12 in one form is a disposable polymeric, e.g., plastic, container liner 13 having a flat bottom 18 and tapered sidewalls 20. The flat bottom 18 makes the container liner 13 suitable for use without being inside of a secondary container, and the tapered sidewalls 20 make the container liner 13 easy to place inside of, and remove from, a secondary container 36. A common element of the container 12 and container liners 13 is a smoking implement 16, herein illustrated as a taster, or sometimes referred to as a one hitter due to the limited size of the bowl 24 (FIG. 2) used for holding the smoking material. In a preferred embodiment, the smoking implement 16 holds about one-tenth of a gram of smoking material, which allows for one or two inhalations before needing to be refilled. In many of the embodiments, FIGS. 3-8 and 12-13, the smoking implement 16 is sized to fit completely inside of the container 12 or container liner 13 and may include a threaded portion 26 and a body portion 28 (FIGS. 21-25). The combination of the threaded portion 26 and the body portion 28 allows the smoking implement to be shortened sufficiently to fit within the container liner 13 for shipping and storage. Removal of the smoking implement 16 allows the threaded portion 26 to be rotated with respect to the body portion 28 to extend the length of the smoking implement 16. Rotation in a reverse direction allows the smoking implement 16 to be shortened for replacement within the container 12 or container liner 13. The container 12 in some embodiments contains a divider wall 30 for separating the smoking implement 16 with respect to the smoking material 32. This construction makes replacing the smoking implement 16 back into the container 12 easier but is not necessary for proper functioning of the system. In a most preferred embodiment, the container liner 13 is sized to fit within the smoking material compartment 34 of a secondary smoking device 36 (FIGS. 9-11); whereby the smoker can utilize a secondary smoking implement 16 that be contained in the secondary container 22 or the smoking implement 16 of the present system to consume the smoking material 32. When the smoking material 32 is consumed, the smoker can pull the container liner 13 out, either by hand or use of a poker placed through an aperture 40 to push the container liner 13 out of the secondary smoking device 36. The poker 123 is preferably contained within the container liner 13, and may be held in place via a magnet 216, friction or the like. In this manner, a smoker can purchase his/her smoking material as pre-ground and cleaned smoking material that is ready to be consumed from a retailer. By simply opening the container liner 13 to open the lid seal 37, e.g. removing the heat seal 35 (FIG. 12) or sealed lid, the smoker is provided with the pre-ground and cleaned smoking material 32 along with a smoking implement 16, both of which are disposable after use. Alternatively, the smoker can use the container 12 or container liner 13 as a refill for other smoking devices and accessories. Again, once the smoking material 32 is consumed, the container 12 or container liner 13 and smoking implement 16 can be discarded. The container 12 and container liner 13 can be provided with a variety of lid members 14 without departing from the scope of the invention. In one embodiment, the lid member 14 is provided as a removable lid (FIGS. 1-13). In this embodiment, the lid member 14 includes a stem 42 sized to fit inside or outside of the container liner sidewall 20 and adjacent thereto to provide an air seal or lid seal 37 to the inner chamber 44 of the container 12 or container liner 13 to keep the moisture relatively constant for the smoking material 32 and to hold the lid member 14 in position. In some embodiments, the lid member 14 may be constructed from a material such as silicone; and in other embodiments, the lid 14 may be constructed from polymeric material such as plastic to include rubber coatings or rubber seals, such as o-rings, to provide the air or lid seal 37 necessary to keep the smoking material 32 in condition for smoking. It should also be noted that tortuous paths and flat surface to surface contact may also be used to provide a satisfactory seal to keep the smoking material fresh without departing from the scope of the invention. In another embodiment, the lid member 14 is constructed to rotate about a pivot pin 46 (FIG. 18). In at least one embodiment, the lid member 14 is also constructed and arranged to require a lift before the rotation of the lid member 14. In these embodiments, the lid member 14 includes a stem 42 sized to fit inside of the inner chamber 44 to maintain moisture and freshness of the smoking material 32 creating the lid seal 37. The pivot pin 46 is thus provided with a spring member 48 which provides closing pressure on the lid member 14 and therefore requires the smoker to pull upward on the lid member 14 before rotation. To replace the lid member 14, the smoker need only rotate the lid member 14 into position, whereby the spring member 48 will cause the downward or closing motion to the lid member 14. It should also be appreciated that this construction does provide child resistance to prevent a child from accessing the smoking materials 32. In some of these embodiments, particularly the silicone lid, the smoker may grasp each distal end of the lid member 14 and flex the ends upwardly to facilitate the rotation of the lid member. In other embodiments, the smoking implement 16 may extend through the lid member 14, 214. In these embodiments, the smoking implement 16 may need to be removed to open the lid member 14, 214, either by pivoting open or by lid removal. Also in these embodiments, a seal member 50 may be provided in the lid member 14, 214 to provide an air and liquid seal around the body 28 of the smoking implement. In other embodiments, a heat seal 35 or the like may be attached to a top surface of the container. The heat seal 35 may be constructed from MYLAR or another material that is resistant to allowing air into the container or moisture out of the container. The heat seal 35 is preferably constructed and arranged to be peeled away from the top surface of the container, but may also be pierced or cut to allow access to the smoking material 32. The lid 14, 214 may be provided with a living hinge (not shown) securing the lid member 14, 214 to the container liner 13. The living hinge may be oriented at any position around the lid member 14, 214 without departing from the scope of the invention. The living hinge allows the container 12 or container liner 13 and the lid member 14 to be constructed as a single piece, wherein the lid is still allowed to be rotated with respect to the container 12 to close the container 12 and provide the necessary seal to preserve the smoking material 32.

Figure 26:
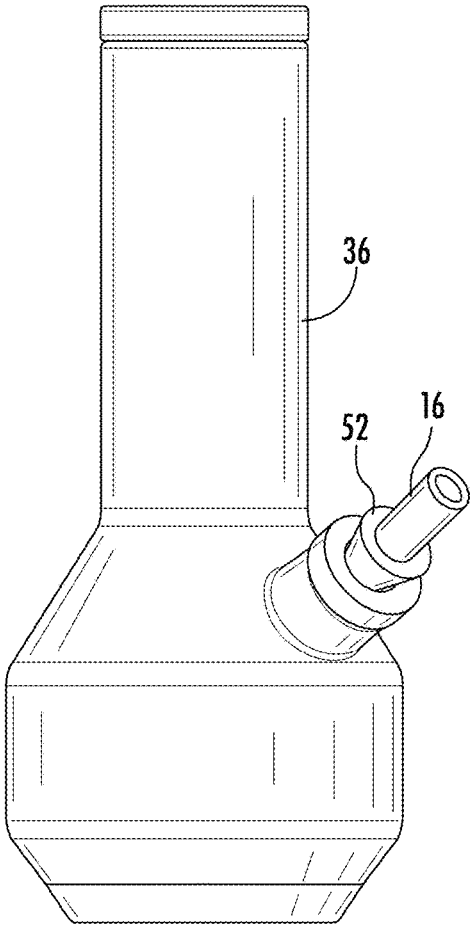
FIG. 26 is a side view illustrating the smoking implement being utilized with a water pipe for smoking the contents of the container liner.
Figure 28:
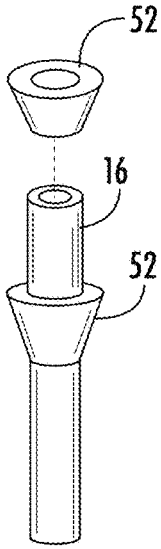
FIG. 28 is a perspective view of the smoking implement being prepared for use with the water pipe.
Figure 27:
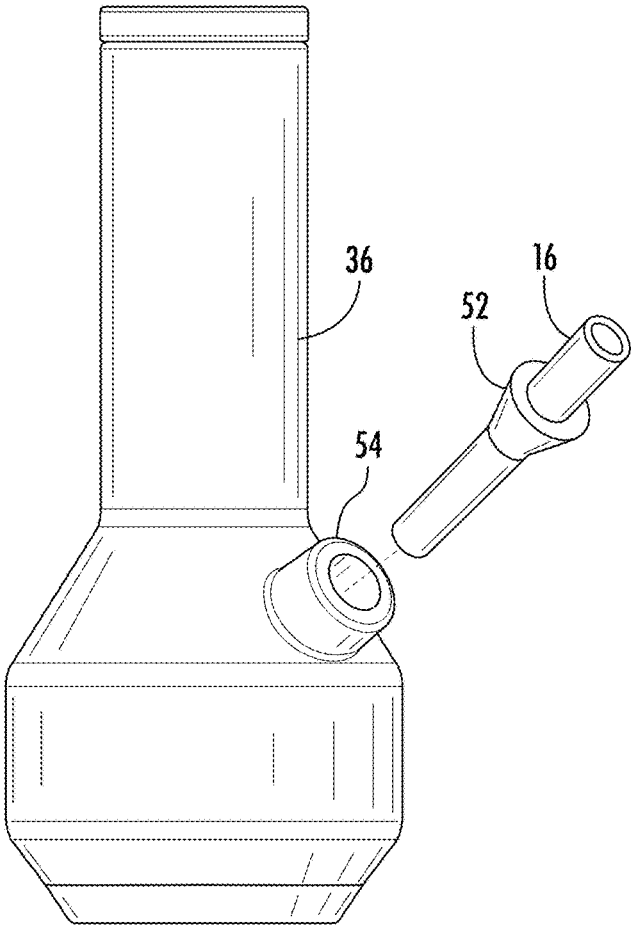
FIG. 27 is a side view illustrating the smoking implement being inserted into a water pipe for smoking the contents of the container liner.
Figure 29:
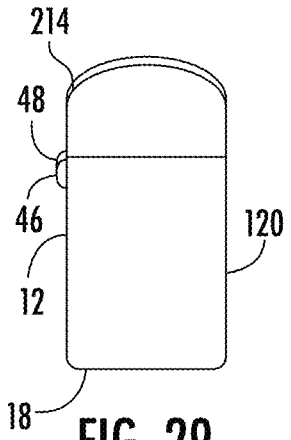
FIG. 29 is a top perspective view illustrating a smoking implement in combination with a hinged lid container in a closed position.

Referring to FIGS. 26-28, use of the smoking implement 16 with other devices is illustrated. In this embodiment, the smoking implement 16 includes a wedge shaped rubber stopper 52 to provide a seal between the stem aperture 54 of a water pipe 36 and the smoking implement 16 of the present system. In this manner, the smoker can fill the smoking implement 16 with smoking material 32 in the container liner 13 and place the implement 16 in the stem aperture 54 to allow consumption of the smoking material 32. After each use, the smoker can refill the smoking implement 16 or place it back in the container liner 13. This or similar methods can be utilized to use the smoking implement 16 across a wide variety of smoking devices without departing from the scope of the invention. The list of smoking devices may include, but should not be limited to water pipes, vaporizers, hookahs and the like.

Figure 31:
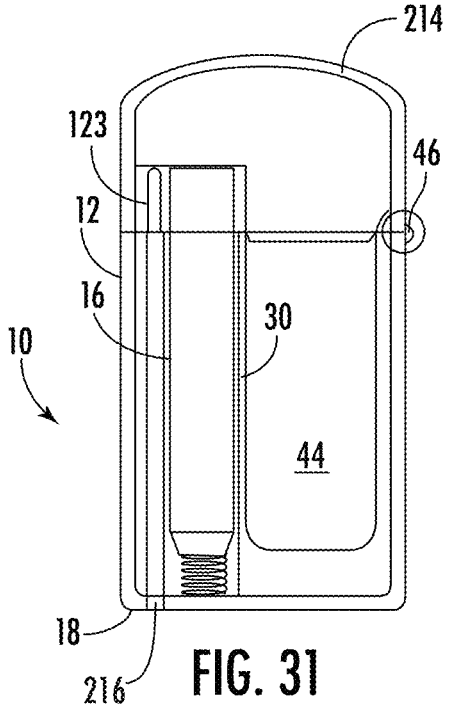
FIG. 31 is a side view of one embodiment of the hinged lid container illustrated to show the storage area, smoking implement and poker tool contained within the hinged lid container.
Figure 32:
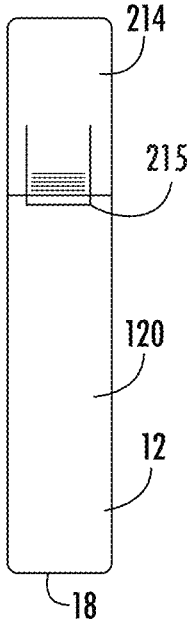
FIG. 32 is a side view of the embodiment shown in FIG. 29 illustrating a grip area for opening the hinged lid.
Figure 30:
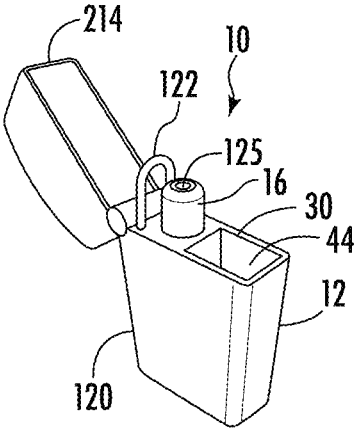
FIG. 30 is a front view illustrating the hinged lid container in an open position.
Figure 33:
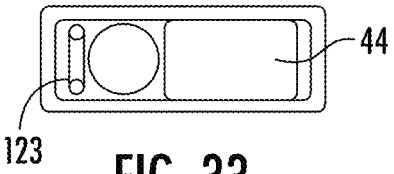
FIG. 33 is a top view illustrating the storage area, smoking implement and poker tool contained within the hinged lid container.
Figure 34:
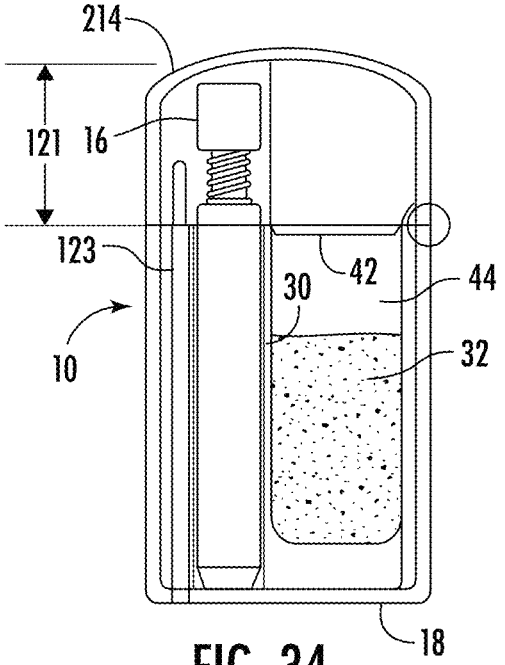
FIG. 34 is an alternative embodiment of the hinged lid container illustrated with an extendable smoking implement, poker and storage area.
Figure 35:
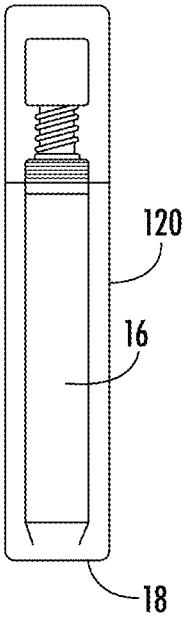
FIG. 35 is a side view of the embodiment illustrated in FIG. 34 illustrating the extendable smoking implement extending into the hinged lid.

Referring to FIGS. 29-35, an embodiment of the smoking system 10 for smoking materials such as tobacco, marijuana, etc. is illustrated. The smoking system 10 includes, in its simplest form, a container 12, a convex lid member 214, and a smoking implement 16. The container 12 in one form is a disposable polymeric, e.g., plastic, container having a flat bottom 18 and sidewalls 120. The flat bottom 18 makes the container 12 suitable for use without being inside of a secondary container; and the sidewalls 120, which may be tapered, make the container 12 suitable for use as a container liner 13 which is easy to place inside of, and remove from, a secondary container 36. A smoking implement 16, herein illustrated as a taster, or sometimes referred to as a one hitter due to the limited size of the bowl 24 (FIG. 2) is used for holding the smoking material. In some of the embodiments, FIGS. 29-33, the smoking implement 16 is sized to fit inside of the container 12 and the convex lid 214, and may include a threaded portion 26 and a body portion 28 (FIGS. 21-25). The combination of the threaded portion 26 and the body portion 28 allows the smoking implement 16 to be shortened sufficiently to fit within the container 12 for shipping and storage. Removal of the smoking implement 16 allows the threaded portion 26 to be rotated with respect to the body portion 28 to extend the length of the smoking implement 16. Rotation in a reverse direction allows the smoking implement 16 to be shortened for replacement within the container 12. In other embodiments, the convex lid 214 includes sufficient internal clearance 121 to allow the smoking implement 16 to be stored in an extended condition as illustrated in FIGS. 34-35. The container 12 in some embodiments contains a divider wall 30 for separating the smoking implement 16 with respect to the smoking material 32. This construction makes replacing the smoking implement 16 back into the container 12 easier, but is not necessary for proper functioning of the system. A poker 123 is preferably also contained within the container 12 and lid 214 for clearing the smoke aperture 125 of the smoking implement 16. In this manner, a smoker can purchase his/her smoking material as pre-ground and cleaned smoking material that is ready to be consumed from a retailer. By simply opening the container 12, the smoker is provided with the pre-ground and cleaned smoking material 32 along with a smoking implement 16 and poker 123 for cleaning the smoking implement 16, all of which are disposable after use. Alternatively, the smoker can use the container 12 as a refill for other smoking devices and accessories. Again, once the smoking material 32 is consumed, the container 12 and smoking implement 16 can be discarded. The container 12 can be provided with a variety of convex lid members 214 without departing from the scope of the invention. In one embodiment, the convex lid member 214 is provided as a removable lid. In this embodiment, the convex lid member 214 includes a stem 42 sized to fit inside or outside of the container wall 120 and adjacent thereto to provide an air seal to the inner chamber 44 of the container 12 to keep the moisture relatively constant for the smoking material 32 and to hold the convex lid member 214 in position. In some embodiments, the convex lid member 214 may be constructed from a material such as silicone; and in other embodiments, the lid 214 may be constructed from polymeric material, such as plastic to include rubber coatings or rubber seals, to provide the seal necessary to keep the smoking material 32 in condition for smoking. In another embodiment, the convex lid member 214 is constructed to rotate about a pivot pin 46 (FIGS. 30-31). In some embodiments, the pivot pin 46 may be provided with a spring member 48 which provides closing pressure on the convex lid member 214. To replace the lid member 214, the smoker need only rotate the lid member 214 into position, whereby the spring member 48 will cause the downward or closing motion to the lid member 214. The lid member 14, 214 may include friction or spring latches 215 that are constructed to be difficult for children to manipulate. It should also be appreciated that this construction may provide child resistance to prevent a child from accessing the smoking materials 32. In some embodiments, the lid 214 may be provided with a living hinge (not shown) securing the lid member 214 to the container 12. The living hinge may be oriented at any position around the lid member 214 without departing from the scope of the invention. This construction facilitates forming the container 112 and the convex lid 214 as a single piece.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A smoking system (10) comprising:

a container (12) having at least one inner chamber (44), a lid member (14) for covering and providing an air seal for the inner chamber, the lid member constructed and arranged for suitable connection to the container (12) to provide for the air seal while also allowing the lid member (14) to be moved between an open position and a closed position, a heat seal (35) attached across a top surface of the inner chamber (44), the heat seal (35) constructed from a material that is resistant to allowing air into the container or moisture out of the container, the heat seal removable to provide access to the contents of the inner chamber (44), a smoking implement (16) sized to fit inside of the inner chamber (44) of the container (12) and the lid member (14) when the lid member is in a closed position, the smoking implement extending out of the inner chamber for manual grasping when the lid member is in an open position, pre-ground and cleaned smoking material (32) within the inner chamber (44), wherein the smoking system (10) is purchased ready to use.

2. The smoking system of claim 1 wherein the heat seal (35) secured across a top surface of the inner chamber (44), is constructed and arranged to be removable by hand to provide access to the smoking material (32).

3. The smoking system of claim 1 wherein the lid member is a convex lid member (214), the convex lid member (214) includes a stem (42) sized to fit inside or outside of a container wall (120) and adjacent thereto to provide an air seal to the inner chamber (44) of the container (12) and to hold the convex lid member (214) in position with respect to the container (12).

4. The smoking system of claim 3 wherein the lid member is a convex lid member (214), the convex lid member (214) is constructed to rotate about a pivot pin (46) between the open and closed positions.

5. The smoking system of claim 4 wherein the pivot pin (46) is provided with a spring member (48) which provides closing pressure on the convex lid member (214).

6. The smoking system of claim 4 wherein the lid member (14) is constructed and arranged to require a lift before the rotation of the lid member (14), a spring member (48) provides closing pressure on the lid member (14).

7. The smoking system of claim 3 wherein the container (12) includes a divider wall (30) for separating the smoking implement (16) with respect to the smoking material (32) inside of the container (12).

8. The smoking system of claim 3 including a poker (123) contained within the container (12) and lid (214) for clearing a smoke aperture (125) of the smoking implement (16).

9. The smoking system of claim 1 wherein the smoking implement (16) includes a threaded portion (26) and a body portion (28), allowing the smoking implement (16) to be shortened for storage and lengthened for use.

10. The smoking system of claim 1 wherein the container (12) is a container liner (13) constructed and arranged to fit inside of a smoking material compartment (34) of a secondary smoking device (36) for consumption of the smoking material.

11. The smoking system of claim 10 wherein the container liner (13) is a polymeric container having a flat bottom (18) and tapered sidewalls (20).

12. The smoking system of claim 1 wherein the smoking implement (16) is a taster constructed and arranged to hold one tenth of a gram of smoking material (32) or less.

13. The smoking system of claim 1 wherein the lid member (14) includes a rubber seal (37).

* * * * *